US005681031A

United States Patent [19]

Foley

[11] Patent Number: 5,681,031

[45] Date of Patent: Oct. 28, 1997

[54] CARPET STRETCHER AND METHOD FOR STRETCHING CARPET

[76] Inventor: Timothy P. Foley, 22023 Sandybrook, South Bend, Ind. 46628

[21] Appl. No.: 488,766

[22] Filed: Jun. 8, 1995

[51] Int. Cl.[6] ..... B25B 25/00

[52] U.S. Cl. ..... 254/209

[58] Field of Search ..... 254/201, 206, 254/207, 209, 210

[56] References Cited

U.S. PATENT DOCUMENTS

| | | | |
|---|---|---|---|
| 21,303 | 8/1858 | Ridley . | |
| 574,122 | 12/1896 | Thompson . | |
| 651,924 | 6/1900 | Johnson . | |
| 723,924 | 3/1903 | Sandy . | |
| 761,127 | 5/1904 | Andres . | |
| 953,877 | 4/1910 | Wegner . | |
| 2,606,743 | 8/1952 | Owens . | |
| 3,441,252 | 4/1969 | Koppelmans . | |
| 3,752,440 | 8/1973 | Ream . | |
| 3,917,225 | 11/1975 | Payson . | |
| 3,977,651 | 8/1976 | Chamberlain | 254/201 |
| 4,230,302 | 10/1980 | Crain, Jr. . | |
| 4,538,846 | 9/1985 | Alexander . | |
| 4,772,058 | 9/1988 | Andersen . | |
| 5,183,238 | 2/1993 | Sorensen . | |

*Primary Examiner*—Daniel P. Stodola
*Assistant Examiner*—Emmanuel M. Marcelo
*Attorney, Agent, or Firm*—Lundy and Associates

[57] ABSTRACT

A carpet stretcher foot comprising a base plate and a carpet stretcher receptacle pivotally connected to the base plate. The base plate has a plurality of nail holes adjacent its periphery. The carpet stretcher receptacle is rotatable about the base plate a full 360° whereby the base plate may be secured to a floor with a carpet therebetween and the receptacle may be rotated relative to the floor and the base plate a full 360° in stretching the carpet. There is also provided a method for stretching carpet comprising removably securing a carpet stretcher foot to a floor with a carpet to be stretched therebetween, the foot having a base plate and a carpet stretcher receptacle pivotally secured to the base plate, the receptacle being rotatable about the base plate a full 360°, the carpet stretcher having a stretcher head and an expandable tube positioned within the receptacle at one end thereof, the stretcher head being secured to the other end of the tube, the tube has opposite ends, stretching the carpet radially away from the foot with the carpet stretcher extending radially from the foot in spaced apart positions extending the length of the expandable tube, repeating the stretching step at radially spaced apart positions, repeating the expanding and the stretching steps until the carpet has been stretched from the foot to the positions adjacent the periphery to the floor, and removing the foot from the floor.

20 Claims, 3 Drawing Sheets

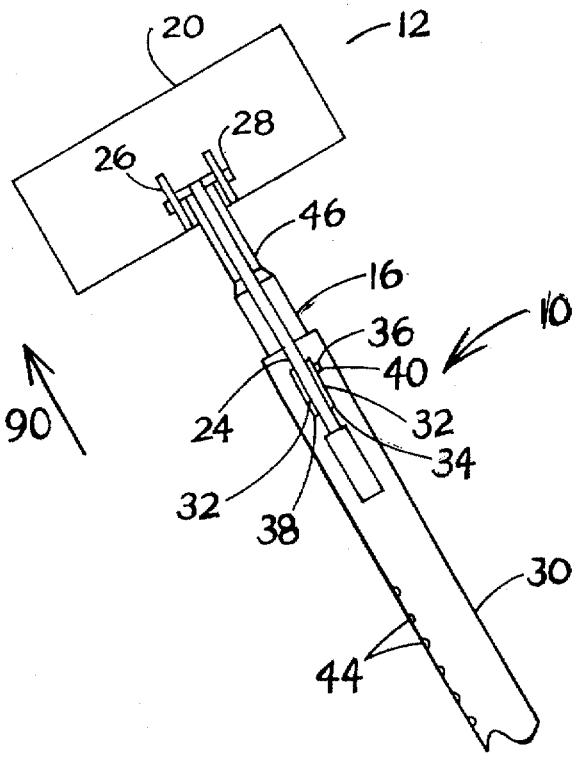
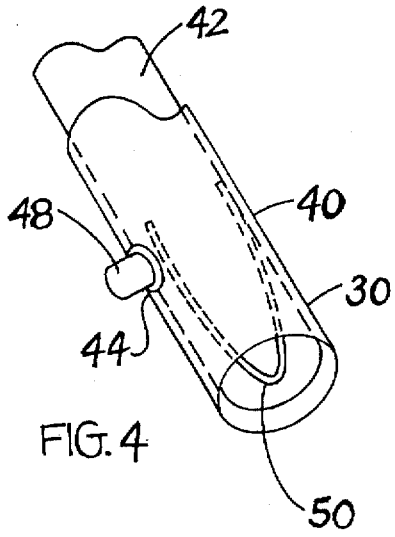
FIG. 4
FIG. 3
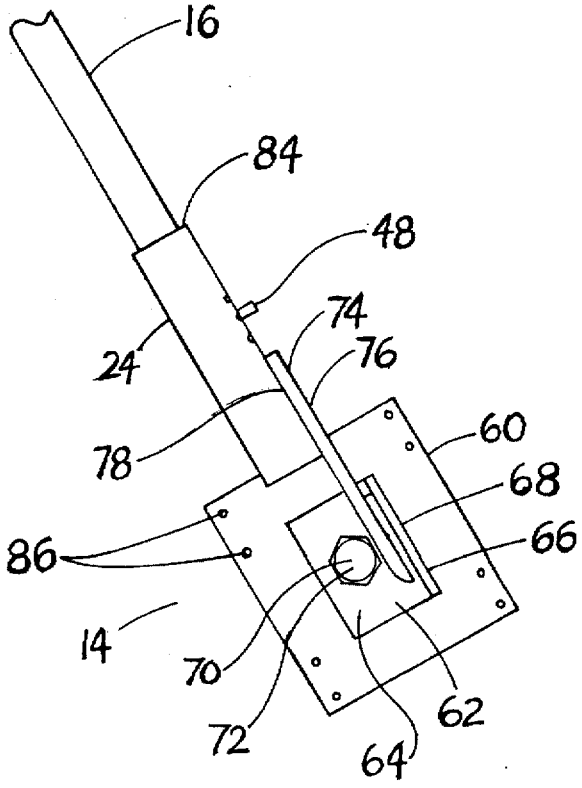

CARPET STRETCHER AND METHOD FOR STRETCHING CARPET

BACKGROUND OF THE INVENTION

The present invention relates to carpet stretchers and a method for carpet stretching, and more particularly to a new carpet stretcher foot which is secured in the middle of a room rather than adjacent a wall and an improved method of carpet stretching which stretches the carpet radially from a position between the walls of a room.

A number of carpet stretchers have heretofore been proposed. Early carpet stretchers were secured adjacent a wall and the carpet was pulled by the stretcher toward the wall. Later, it was recognized that pulling carpet was not as easily accomplished as pushing the carpet. Thus, later carpet stretchers had a foot abutting against one wall and stretched the carpet from that wall outwardly toward an opposite wall. Problems occurred in utilizing these stretchers where the rooms were extremely large as the stretching force buckled the stretchers at median points between where the force was applied to the wall and the stretcher was engaged to the carpet.

More recently, frames have been proposed which extend between opposite walls of long rooms in which the carpet is stretched between members of the frame. The frame prevents the carpet stretcher from buckling as experienced in the past, however, extremely long stretching mechanisms were still required. Artificial supports were provided such that stretchers could be anchored at positions between opposite walls and the carpet stretched in opposite directions toward each wall. Of those carpet stretchers which stretch from the center of the room, each of the mechanisms heretofore known stretch the carpet either longitudinally of the room or transversely of the longitudinal direction generally perpendicularly between opposite walls. With most of these devices, the carpet is first stretched between one set of opposite walls and then stretched between the other set of opposite walls. A few devices have heretofore been proposed whereby carpet is stretched simultaneously in all four directions from the center of the room. However, even these devices require the carpet to be stretched only in directions generally perpendicular to the wall and in only limited directions.

Therefore, it is highly desirable to provide a new and improved carpet stretcher. It is also highly desirable to provide an improved carpet stretcher which allows the carpet to be stretched in all directions desired as the need occurs. It is also highly desirable to provide an improved carpet stretcher whereby the distance over which the carpet is stretched may be minimized even in a relatively large room.

Because of the cost of special equipment, and in the necessity to lay carpet in a variety of locations each having different configurations, it is highly desirable to provide an improved carpet stretcher foot modifying conventional carpet stretching apparatus so as to stretch carpet both in small rooms and large rooms. Therefore, it is highly desirable to provide a new and improved carpet stretcher foot to modify the carpet stretcher such that the foot is secured in the middle of the room. It is also highly desirable to provide such a foot which allows for the carpet stretcher to stretch the carpet in all directions extending radially extending from the foot as desired.

Older carpets were generally woven having a warp extending lengthwise of the carpet and a filling extending transversely to the lengthwise direction. Woven carpets generally were stretched in either the direction of the warp or the filling. Modern carpets are not woven and do not necessitate stretching in directions perpendicular to each other. Therefore, it is highly desirable to provide an improved carpet stretcher and method for stretching carpets radially from a point located midway between opposite walls of a room. It is also highly desirable to provide an improved method for carpet stretching. Finally, it is highly desirable to provide an improved carpet stretcher for performing the method of the invention.

It is therefore highly desirable to provide a new and improved carpet stretcher.

It is also highly desirable to provide an improved carpet stretcher Which allows the carpet to be stretched in all directions desired as the need occurs.

It is also highly desirable to provide an improved carpet stretcher whereby the distance over which the carpet is stretched may be minimized even in a relatively large room.

It is also highly desirable to provide an improved carpet stretcher foot modifying conventional carpet stretching apparatus so as to stretch carpet both in small rooms and large rooms.

It is also highly desirable to provide a new and improved carpet stretcher foot which may be exchanged for the conventional carpet stretcher foot to modify the carpet stretcher such that the foot is secured in the middle of the room as desired.

It is also highly desirable to provide such a foot which allows for the carpet stretcher to stretch the carpet in any direction extending radially from the foot as desired.

It is also highly desirable to provide an improved carpet stretcher and method for stretching carpets radially from a point located midway between opposite walls of a room.

It is also highly desirable to provide an improved method for carpet stretching.

It is also highly desirable to provide an improved carpet stretcher for performing the method of the invention.

It is finally highly desirable to provide an improved carpet stretcher and method having all of the above-identified features.

SUMMARY OF THE INVENTION

It is therefore an object of the invention to provide a new and improved carpet stretcher.

It is also an object of the invention to provide an improved carpet stretcher which allows the carpet to be stretched in all directions desired as the need occurs.

It is also an object of the invention to provide an improved carpet stretcher whereby the distance over which the carpet is stretched may be minimized even in a relatively large room.

It is also an object of the invention to provide an improved carpet stretcher foot modifying conventional carpet stretching apparatus so as to stretch carpet both in small rooms and large rooms.

It is also an object of the invention to provide a new and improved carpet stretcher foot which may be exchanged for the conventional carpet stretcher foot to modify the carpet stretcher such that the foot is secured in the middle of the room as desired.

It is also an object of the invention to provide such a foot which allows for the carpet stretcher to stretch the carpet in any direction extending radially from the foot as desired.

It is also an object of the invention to provide an improved carpet stretcher and method for stretching carpets radially from a point located midway between opposite walls of a room.

It is also an object of the invention to provide an improved method for carpet stretching.

It is also an object of the invention to provide an improved carpet stretcher for performing the method of the invention.

It is finally an object of the invention to provide an improved carpet stretcher and method having all of the above-identified features.

In the broader aspects of the invention, there is provided a carpet stretcher foot comprising a base plate and a carpet stretcher receptacle pivotally connected to the base plate. The base plate has a plurality of nail holes adjacent its periphery. The carpet stretcher receptacle is rotatable about the base plate a full 360° whereby the base plate may be secured to a floor with a carpet therebetween and the receptacle may be rotated relative to the floor and the base plate a full 360° in stretching the carpet.

There is also provided a method for stretching carpet comprising removably securing a carpet stretcher foot to a floor with a carpet to be stretched therebetween, the foot having a base plate and a carpet stretcher receptacle pivotally secured to the base plate, the receptacle being rotatable about the base plate a full 360°, the carpet stretcher having a stretcher head and an expandable tube positioned within the receptacle at one end thereof, the stretcher head being secured to the other end of the tube, the tube has opposite ends, stretching the carpet radially away from the foot with the carpet stretcher extending radially from the foot in spaced apart positions extending the length of the expandable tube, repeating the stretching step at radially spaced apart positions, repeating the expanding and the stretching steps until the carpet has been stretched from the foot to the positions adjacent the periphery to the floor, and removing the foot from the floor.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein:

FIG. 3 is a fragmentary view of the improved carpet stretcher of the invention showing both the head of FIG. 2 and the foot of FIG. 1 coupled together with a plurality of telescoping extension tubes.

FIG. 4 is an enlarged fragmentary view showing the detail of the telescoping tubes of FIG. 3.

DESCRIPTION OF A SPECIFIC EMBODIMENT

Figure 1:
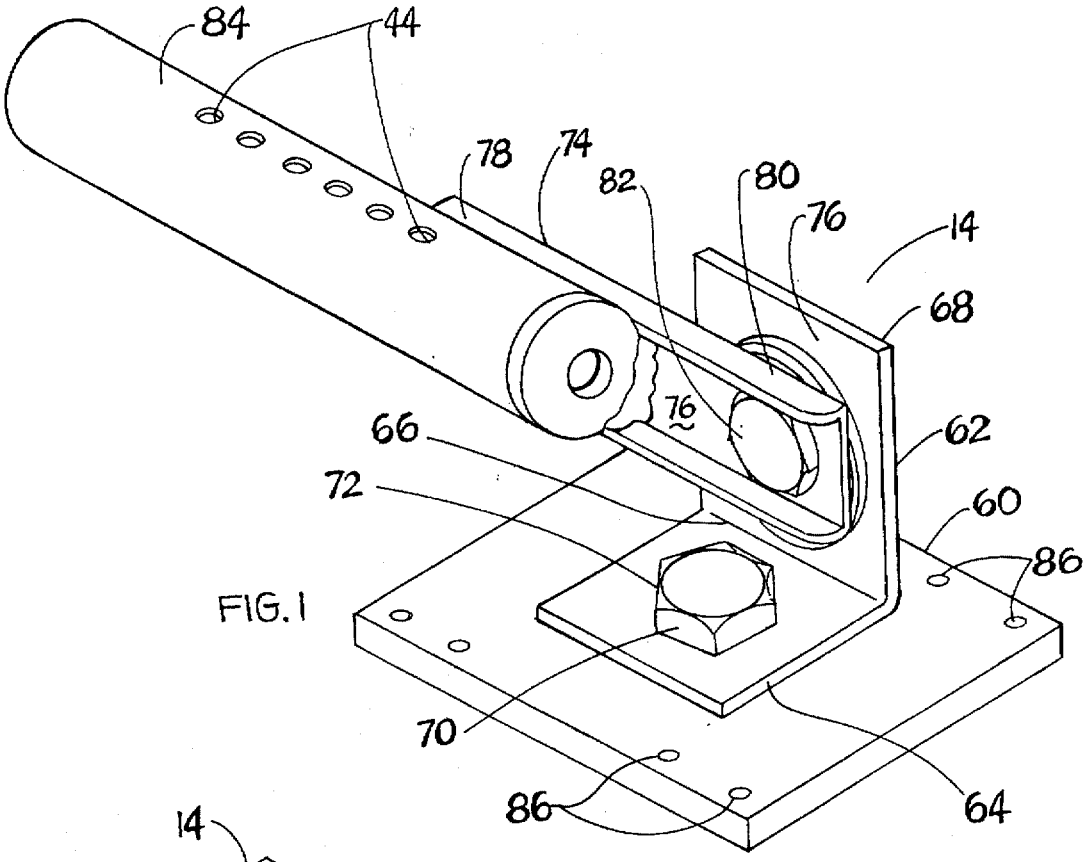
FIG. 1 is a perspective view of the improved carpet stretcher foot of the invention.
Figure 2:
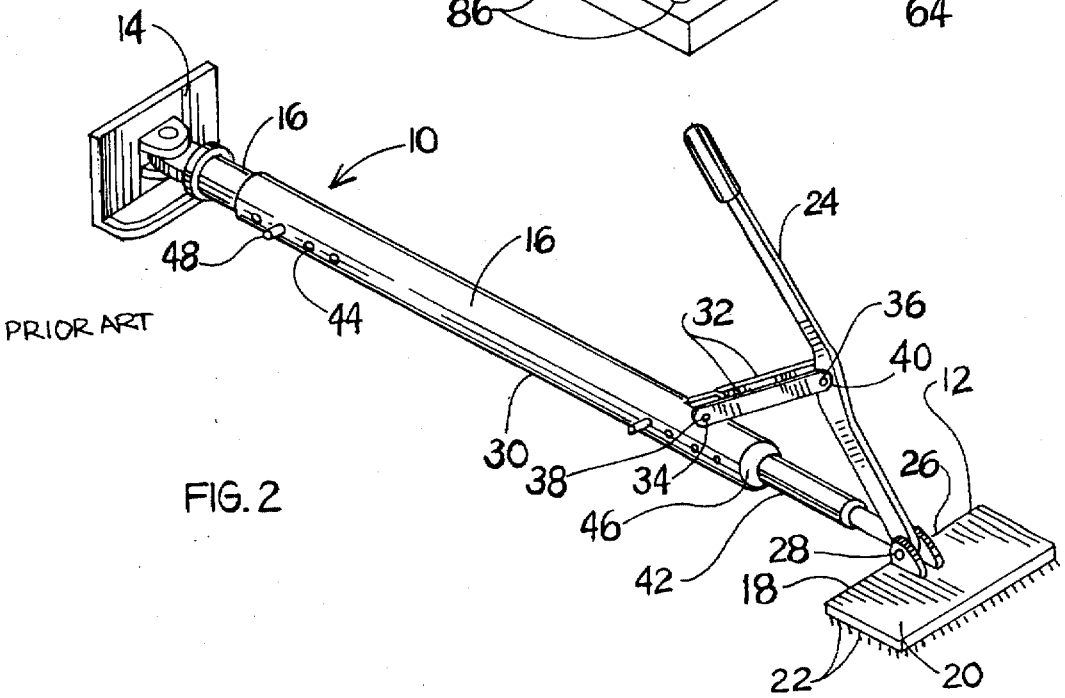
PRIOR ART FIG. 2
FIG. 2 is a perspective view of a relatively conventional carpet stretcher of the type well known to those skilled in the art to be in the prior art.

The carpet stretcher 10 of the invention includes a stretcher head 12 and a stretcher foot 14 connected together but separated by a plurality of telescoping tubular extensions 16.

Stretcher head 12 is always conventional. While there is a variety of stretcher heads available for use, a commonly used stretcher head 12 comprises a pin head 18 which is generally in the form of a rectangular plate 20 having a plurality of rows of forwardly angled parallel pins 22 extending downwardly therefrom, a handle 24 is pivotally secured to the head 12 by a pair of lugs 26 secured to the head 12 and a pivot pin 28 extending through lugs 26 and handle 24. Handle 24 is also pivotally connected to lug 29 secured to stretcher tube 30 by linkages 32 and pivot pins 34 and 36. Each of the links 32 have an opening therethrough adjacent their opposite ends 38 and 40. Pivot pins 34 and 36 extend through links 32 adjacent ends 38, 40 and through handle 24 and lug 29 at a position spaced from pivot pin 28.

Extending from head 12 is a connector tube 42 which is telescopically received within extension tube 30 at its distal end. Head 12 and extension tube 30 are connected to foot 14 by a plurality of extension tubes 30 by a plurality of connector tubes 42. Each of the tubes 30 adjacent their distal ends 46 have a plurality of spaced apart openings 44 formed therein. Each of the connector tubes 42 have a single opening adjacent its distal end 46 and a detent pin 48 extending through the opening 44 urged by a spring 50. See FIG. 4. As will be explained hereinafter, there may be as many extension tubes 30 as desired and as many connector tubes 42 as required.

Secured to extension tubes 30 at the distal end opposite head 12 is foot 14. Foot 14 comprises base 60, an angle iron 62 having a base plate 64 connected by a fold 66 to an upstanding plate 68. Angle 62 is pivotally secured to base plate 60 by a pivot pin 70. Pivot pin 70 has an enlarged head 72 which overlays base plate 64 and base 60 with a shank therebetween about which angle 62 may rotate 360 degrees. A channel 74 is secured to upstanding plate 68. Channel 74 has a base 76 and a pair of longitudinally extending, essentially parallel flanges 78 upstanding from base 76. A pivot pin 80 extends through an opening in base 76 and through plate 68. An enlarged head 82 is positioned both on plate 68 and base 76 between upstanding flanges 78. Channel 74 can rotate around pivot pin 80 upwardly and downwardly, toward and away from base plate 60 between engagements with base plate 64 and the floor, as will be mentioned hereinafter.

Secured to channel 74 and base 76 between upstanding flanges 78 is an extension tube receptacle 84. Tube receptacle 84 is secured to both the opposite flanges 78 and the flange base 76. Tube receptacle 84 is can be pivoted along with channel 74 about pivot pin 80 as aforedescribed. Base 60 has a plurality of nail openings 86 spaced along its perimeter to attach foot 14 to the floor as will be described in detail hereinafter.

In operation, the carpet stretcher 10 of the invention may be utilized to perform the improved method of stretching carpet of the invention. The carpet stretcher 10 may be used to stretch carpet both in accordance with the method of the invention, and as is conventional. The foot 14 is secured to the floor at a position away from which the carpet is to be stretched. The securance of foot 14 to the floor is by placing nails through nail openings 86 and driving them into the floor through the carpet to be laid. The carpet stretcher 10 is then assembled as shown in FIG. 3 having the two extension tubes 30 secured together by a single connector tube 42. The carpet is then stretched outwardly away from the foot 14 in the direction of the arrow 90. The stretching is accomplished in the conventional manner by securing the stretcher plate 20 to the carpet to be stretched by means of pins 22 with the handle 24 in its elevated position and lowering the handle 24 to a position overlaying the extension tubes 30 and then repeating this process until the carpet is stretched to the desired tension. The head 12 is then disengaged from the carpet, replaced in the carpet in a different position, and the procedure repeated.

In a conventional manner, the carpet is stretched from the foot 14 toward an opposite wall of the room. Once the carpet is stretched all the way to the wall, the carpet is attached to the floor by conventional means such as by tacks or by a tack pad adjacent the wall.

Figure 5:
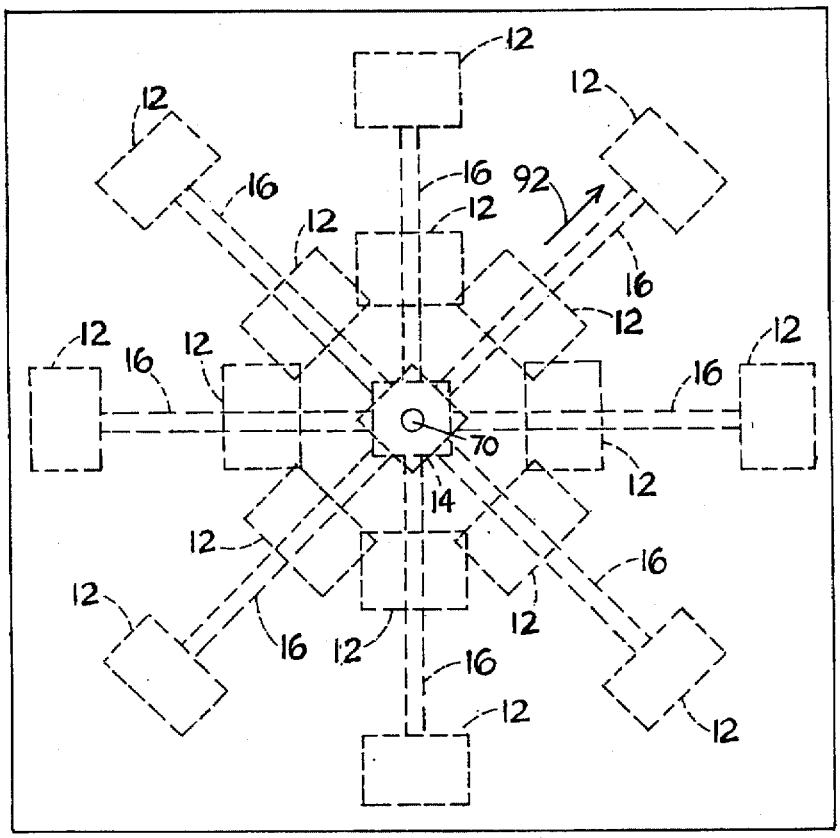

The performance of the method of the invention is accomplished by securing the foot 14 of the carpet stretcher 10 of the invention in the middle of a room remote from all of the walls and stretching the carpet generally radially thereof as shown in FIG. 5. In performing the method of the invention, the foot is secured as above described in the middle of the room by placing nails within the nail openings 86 and driving the nails through the openings 86 through the carpet to be stretched and into the floor. The carpet is then stretched in each of the radial directions shown in FIG. 5. One may start in any of the directions shown. For the purpose of this description, the stretching will start in direction 92. The head 12 and foot 14 are secured together as shown in FIG. 3 at its shortest length 94 and stretched in all radial directions 92 outwardly of the foot 14 toward the walls. Once the carpet is stretched all the way to the walls, it is secured at that point.

The carpet stretching is proceeded by rotating the carpet stretcher 10 about the pivot point 70 in a clockwise direction. In another specific embodiment, one could stretch the carpet by rotating the carpet stretcher 10 in a counterclockwise direction. In still another specific embodiment, the carpet could be stretched by choosing directions randomly or in a pattern such as "one o'clock," "ten o'clock," "three o'clock," "nine o'clock," "five o'clock," "seven o'clock," "twelve o'clock" and "six o'clock." Whatever the manner the carpet is stretched, the carpet stretcher 10 is always secured in accordance with the method to the approximate center of the room and the carpet is stretched radially by varying the position of the carpet stretcher 10. The carpet is stretched as is conventional utilizing the head 12 and the handle 24.

Figure 6:
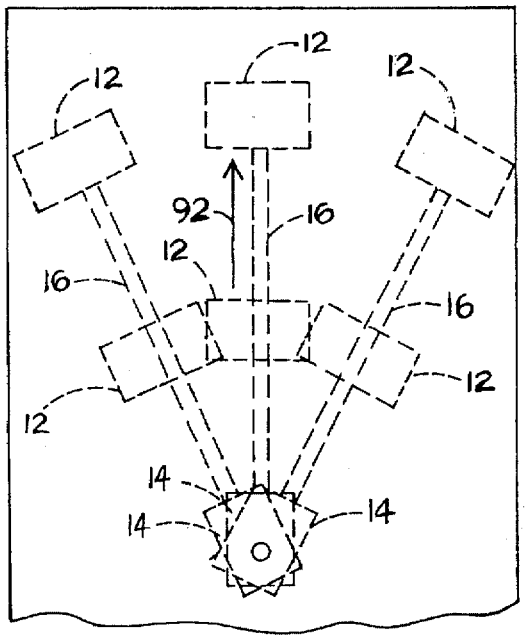
FIG. 5 and FIG. 6 are top plan views of a room in which carpet is being laid illustrating the improved carpet stretcher method of the invention.

Whenever the room is more elongated than shown in FIG. 5, the carpet is stretched only longitudinally by the method of the invention toward the ends of the room as shown in FIG. 6. By the method of the invention, the foot 14 of the invention is secured adjacent one end of the room with the nails extending through the openings 86 through the carpet and into the floor as above mentioned. The carpet is then stretched lengthwise in the room in direction 92 and then in the same manner in adjacent radial directions as shown. The carpet stretcher 10 is then disassembled, the foot 14 rotated 180 degrees and the carpet is stretched in the same manner toward the opposite end of the room.

By the method of the invention, the carpet can be stretched evenly in all radial directions of the room. By securing the foot 14 in the center of the room, as shown in FIG. 5, or in the near middle median position between opposite end walls, shown in FIG. 4, one can count the number of handle moves it took to stretch the carpet toward one wall or end, and then duplicate the same number of handle moves in the opposite direction thereby stretching the carpet evenly in the approximate same amount in opposite directions. Heretofore, this has not been possible in all radial directions. As the carpet stretchers prior to this could not assume all radial positions and the only way to accomplish the same result would be to stretch the carpet in some of the radial positions and to finish the same by manual "knee bumper" stretchers which by most operating standards cannot stretch the carpet as forcefully with a carpet stretcher such as stretcher 10.

In a specific embodiment, the stretcher head 12 and extension tubes 16 can be any one of the stretcher head and extension tubes which are manufactured and sold by Gunlauch, Roberts, Crain and National. The stretcher foot 14 may be a short length of extension tubing such as sold by Gunlauch, Roberts, Crain and National, secured by welding to a channel 74 which is a conventional U-shaped, ¼ inch steel flange. Both plate 60 and angle 62 may be formed of ⅜", 5/16" or ¼" steel plate and pivot pins 70 and 80 may be conventional ½" threaded bolts.

As above described, a new and improved carpet stretcher 10 and method for stretching carpet is provided by the invention. The carpet stretcher 10 and method of the invention allows the carpet to be stretched in any direction desired as the need occurs whereby the distance over the carpet stretched may be minimized even in relatively large rooms and the carpet may be stretched evenly in all directions. The improved carpet stretcher 10 and method of the invention allows for the modification of conventional carpet stretching apparatus to be used in both small and larger rooms.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A carpet stretcher foot comprising a base plate and a carpet stretcher receptacle pivotally connected to said base plate, said base plate having a plurality of nail holes adjacent its periphery, an angle pivotally connected to said base plate, said angle having an upstanding portion, said receptacle being secured to a channel, said channel being pivotally connected to said upstanding angle portion, said channel being rotatable both up and down from said base plate and about said base plate a full 360° with said receptacle, said channel base overlaying said angle upstanding portions, and further comprising a pivot extending through said channel base and said upstanding portion, said channel base and upstanding portions having contiguous bearing surfaces about which said receptacle rotates whereby said base plate may be secured to a floor with a carpet therebetween and said receptacle rotated relative to said floor and said base plate a full 360° in stretching said carpet.

2. The carpet stretcher foot of claim 1 wherein said receptacle is tubular, said receptacle is secured to a channel, said channel being pivotally connected to said base plate, said channel being rotatable about said base plate a full 360°.

3. The carpet stretcher foot of claim 2 wherein said channel has a base and two spaced upstanding flanges, said receptacle is secured to said channel base between said flanges.

4. The carpet stretcher foot of claim 1 further comprising an angle pivotally connected to said base plate, said angle including a generally horizontal portion and a generally upstanding vertical portion, said horizontal portion overlaying said base plate, a pivot extending through said base plate and through said overlaying portion, said base plate and said generally horizontal portion of said angle having contiguous bearing surfaces about which said carpet stretcher receptacle rotates 360° with respect to said base.

5. The carpet stretcher foot of claim 4 wherein said pivot comprises a bolt including a head and a threaded shank and a nut, said base plate having a recess therein facing oppositely of said angle, said bolt being in said recess.

6. The carpet stretcher foot of claim 5 wherein one of said head and nut being in said recess.

7. The carpet stretcher foot of claim 1 wherein said pivot including a bolt having a head and threaded shank and a nut, said bolt extending through said upwardly extending portion of said angle and through said base of said channel, said bolt being between said upstanding flanges of said channel.

8. The carpet stretcher foot of claim 7 wherein one of said head and nut are between said flanges of said channel, said head and nut have opposite planar surfaces, two of said planar surfaces engaging said upstanding flanges of said channel.

9. The method for stretching carpet comprising the steps of removably securing a stretcher foot to a floor with a carpet to be stretched therebetween, said foot having a base plate, a carpet stretcher receptacle pivotally secured to said base plate, an angle pivotally connected to said base plate, said angle having an upstanding portion, said receptacle being secured to a channel, said channel being pivotally connected to said upstanding angle portion, said channel being rotatable both up and down from said base plate and about said base plate a full 360° with said receptacle, said channel base overlays said angle upstanding portion, and further comprising a pivot extending through said channel base and said upstanding portion, said channel base and upstanding portions having contiguous bearing surfaces about which said receptacle rotates, said receptacle being rotatable about a generally vertical axis relative to said base plate a full 360°, a carpet stretcher having a stretcher head and an elongated tube expandable in length and having opposite ends, said tube positioned within said receptacle at one of said opposite ends thereof, said stretcher head being secured to the other of said opposite ends of said tube, stretching said carpet radially away from said foot with said carpet stretcher extending radially from said foot in spaced apart positions, extending the length of said expandable tube, repeating said stretching step at radially spaced apart positions, repeating said expanding and said stretching steps until the carpet has been stretched from said foot to said positions adjacent the periphery of said carpet, attaching said carpet periphery to said floor, and removing said foot from said floor.

10. The method of claim 9 wherein said attaching step utilizes a tack rail adjacent the walls of a room.

11. The method of claim 9 wherein said foot is secured to the floor of an elongated room having side walls and end walls, said end walls being spaced apart a greater distance than said sides of said room, said foot being spaced from both side ends walls and side walls.

12. The method of claim 9 wherein said foot is secured to the floor of a room having walls generally equally spaced from said middle.

13. The method of claim 9 wherein said receptacle is tubular and said receptacle is secured to a channel, said channel being pivotally connected to said base plate, said channel being rotatable about said base plate a full 360° with said receptacle.

14. The method of claim 9 wherein said channel has a base and two spaced upstanding flanges, said receptacle is secured to said channel base between said flanges.

15. The method of claim 9 further comprising an angle pivotally connected to said base plate, said angle including a generally horizontal portion and a generally upstanding vertical portion, said horizontal portion overlaying said base plate, a pivot extending through said base plate and through said overlaying portion, said base plate and said generally horizontal portion of said angle having contiguous bearing surfaces about which said carpet stretcher receptacle rotates 360° with respect to said base.

16. The method of claim 15 wherein said pivot comprises a bolt including a head and a threaded shank and a nut, said base plate having a recess therein facing oppositely of said angle, said bolt being in said recess.

17. The method of claim 16 wherein one of said head and nut being in said recess.

18. The method of claim 9 wherein said pivot including a bolt having a head and threaded shank and a nut, said bolt extending through said upwardly extending portion of said angle and through said base of said channel, said bolt being between said upstanding flanges of said channel.

19. The method of claim 9 wherein the expanding and stretching steps are performed randomly.

20. The method of claim 9 wherein said expanding and stretching steps are performed in one direction before another.

* * * * *